US005199140A

United States Patent [19]

Valiulis et al.

[11] Patent Number: 5,199,140

[45] Date of Patent: Apr. 6, 1993

[54] INVENTORY CONTROL CLIP FOR DISPLAY HANGERS

[75] Inventors: Stanley C. Valiulis, Rockford; Randy D. Long, Durand, both of Ill.

[73] Assignee: Southern Imperial, Inc., Rockford, Ill.

[21] Appl. No.: 785,315

[22] Filed: Oct. 30, 1991

[51] Int. Cl.[5] ..... A41F 1/00; A44B 17/00

[52] U.S. Cl. ..... 24/545; 24/542; 24/562

[58] Field of Search ..... 24/545, 542, 562, 537, 24/489, 346; 223/85; 211/59.1

[56] References Cited

U.S. PATENT DOCUMENTS

| | | | |
|---|---|---|---|
| 1,761,630 | 6/1930 | Jentizen | 24/562 |
| 1,899,982 | 3/1933 | Olson | 24/489 |
| 3,100,324 | 8/1963 | Tutino et al. | 24/542 |
| 3,616,497 | 11/1971 | Esposito, Jr. | 24/542 |
| 4,217,986 | 8/1980 | Brown | 211/57.1 |
| 4,566,157 | 1/1986 | Packendorff | 223/85 |
| 4,763,390 | 8/1988 | Rooz | 24/562 |
| 4,869,376 | 9/1989 | Valiulis et al. | 211/59.1 |
| 4,976,058 | 12/1990 | Valiulis | 40/657 |

FOREIGN PATENT DOCUMENTS

| | | | |
|---|---|---|---|
| 0242186 | 1/1961 | Australia | 24/545 |

*Primary Examiner*—Victor N. Sakran

*Attorney, Agent, or Firm*—Leydig, Voit & Mayer

[57] ABSTRACT

A clip for holding merchandise near the forward end portion of either a single-armed display hanger or a loop-type hanger and for maintaining a predetermined vertically spaced relationship between the hanger and the overlying arm of a label holder. The clip may be adjusted to different vertical positions on the hanger to allow changing of the vertical spacing between the label holder arm and the hanger.

9 Claims, 1 Drawing Sheet

INVENTORY CONTROL CLIP FOR DISPLAY HANGERS

BACKGROUND OF THE INVENTION

The invention relates to an inventory control device or clip for use with display hangers or hooks of the type which are attached to a perforated panel such as a "Pegboard" and which serve to hold and display retail merchandise. An inventory control device may be slid to different positions along the length of the hanger and acts to keep the merchandise positioned near the outer end of the hanger.

One type of inventory control device is disclosed in Valiulis et al U.S. Pat. No. 4,869,376. That device is usable with a so-called loop hook of the type comprising a pair of horizontally spaced arms joined integrally at their outer ends and defining a U-shaped configuration when viewed from above. The control device of the Valiulis et al patent also may be used with a scanner hook having a single lower horizontally extending hanger arm for supporting merchandise and having an upper parallel arm for supporting a price tag or label which may be "read" by an electronic scanning wand.

Valiulis U.S. Pat. No. 4,976,058 discloses a snap-on, arm-type label holder which is used in place of a scanner hook. The label holder includes an elongated arm, a plate for a label at the outer end of the arm, and a mounting bracket at the inner end of the arm. The mounting bracket includes multiple sets of notches which enable the label holder to be used universally with loop-type display hangers or with single-armed display hangers. Moreover, the label holder may be selectively adjusted to different heights so as to enable the holder to be positioned in accordance with the nature of the merchandise on the display hanger.

SUMMARY OF THE INVENTION

The general aim of the present invention is to provide a new and improved inventory control device which may be used universally with either loop-type hangers or single-armed hangers, which holds the arm of a universal label holder in vertically spaced relation with the hanger, and which may be easily adjusted to accommodate the height of the label holder arm.

A more detailed object of the invention is to provide an inventory control device which snaps onto and extends downwardly from the label holder arm and which either adjustably straddles a single-armed hanger or is located adjustably between the arms of a loop-type hanger.

These and other objects and advantages of the invention will become more apparent from the following detailed description when taken in conjunction with the accompanying drawings.

DETAILED DESCRIPTION OF THE PREFERRED EMBODIMENTS

Figures 1, 2, 3, 4, 5:
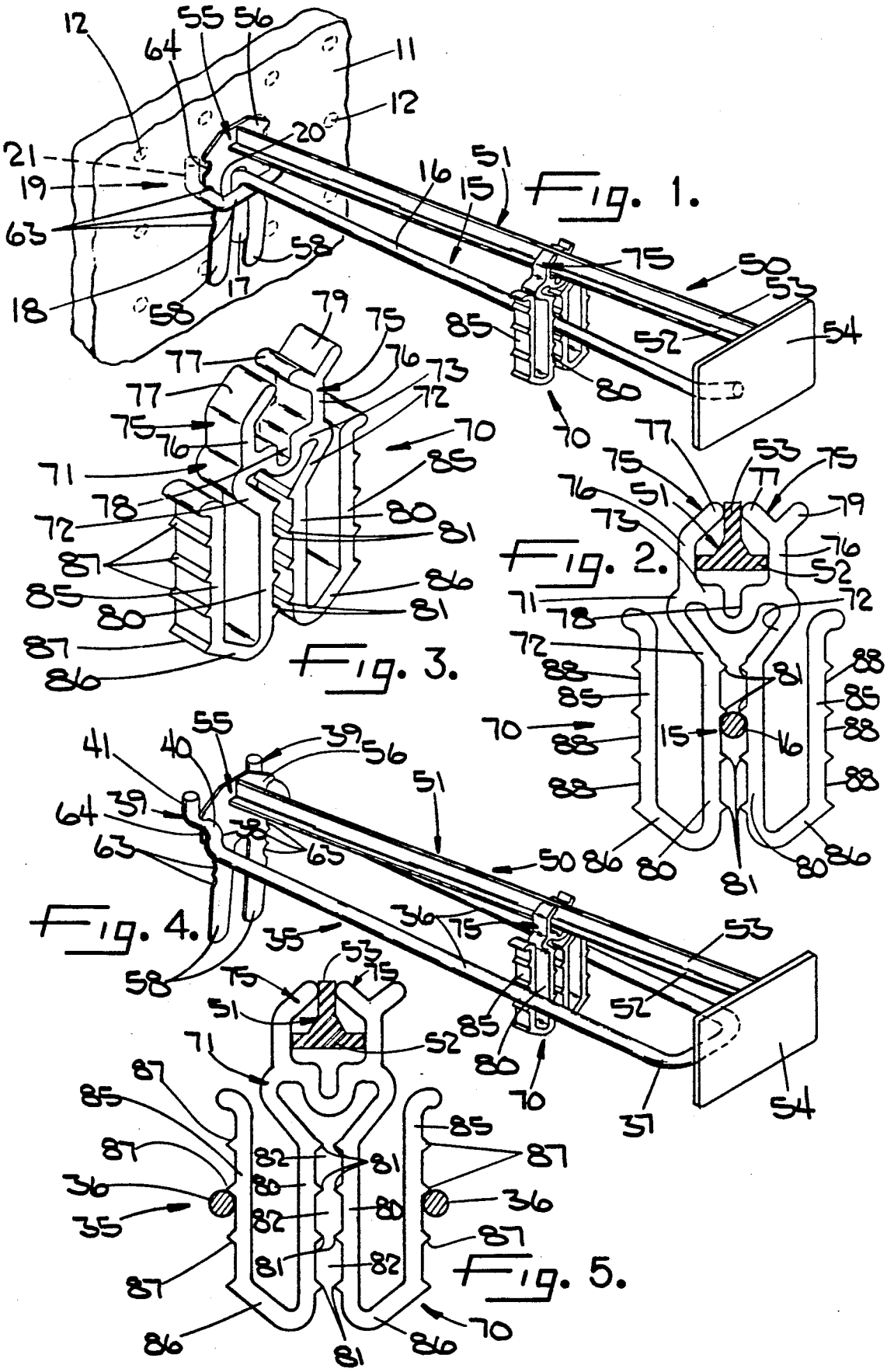
FIG. 1 is a perspective view of an arm-type label holder and a single-armed display hanger equipped with a new and improved inventory control device incorporating the unique feature of the present invention.
FIG. 2 is an enlarged front elevational view of the inventory control device, the arms of the label holder and the display hanger being shown in section.
FIG. 3 is a perspective view of the inventory control device shown in FIG. 2.
FIGS. 4 and 5 are views similar to FIGS. 1 and 2, respectively, but show the inventory control device in conjunction with a loop-type hanger.

For purposes of illustration, the invention has been shown in the drawings in conjunction with hangers for supporting articles from a perforated panel or "Pegboard" 11 of the type formed with a series of vertically spaced and horizontally extending rows of holes 12. By way of example, the articles may be bags (not shown) within which merchandise is contained. The upper end portion of each bag is formed with a hole to enable the bag to be hung from the hanger.

Two different types of hangers have been illustrated. The first hanger 15 is shown in FIGS. 1 and 2 and is a single-armed hanger. Such a hanger includes an elongated hanger arm 16 made of round wire and having an integral depending finger 17 at its inner end. A round wire mounting piece includes a horizontal section 18 located beneath the inner end of the arm and welded to the outer side of the finger. Horns 19 are formed integrally with each end of the cross-piece 18. Each horn includes a horizontal portion 20 projecting inwardly through a hole 12 in the panel 11 and further includes a vertical portion 21 which hooks behind the inner side of the panel.

The hanger 15 is attached to the panel 11 by locating the hanger in a vertical position with the hanger arm 16 pointing upwardly and with the portions 21 of the horns 19 pointing toward and aligned with a pair of horizontally spaced holes 12 in the panel. The hanger is first moved inwardly to cause the horn portions 21 to enter the holes 12 and then is swung downwardly and pushed inwardly to cause the horn portions 21 to hook behind the panel and to cause the horn portions 20 to move into the holes. When the hanger is in its installed position, the finger 17 engages the outer face of the panel 11 to limit downward swinging of the hanger.

The second type of hanger 35 which has been illustrated is shown in FIGS. 4 and 5 and is a so-called loop hook. The hanger 35 is made of round wire which is bent so as to form two laterally spaced and generally horizontally extending hanger arm sections 36 adapted to extend outwardly from the panel 11 and adapted to extend through elongated slots formed in the upper ends of the merchandise bags. The outer end portions of the hanger arm sections 36 are bent laterally and reversely toward one another and define a convexly rounded tip portion 37 at the outer end of the hanger.

Horns 39 are formed integrally with the inner ends of the arm sections 36 of the hanger 35. Herein, each horn includes a first vertical portion 38 at the inner end of the arm section 36, a horizontally extending portion 40, and a second vertical portion 41 at the inner end of the horizontal portion. The hanger 35 is installed on the panel 11 in the same manner as the single-armed hanger 15. When the hanger 35 is swung downwardly, the vertical portions 38 of the horns 39 engage the forward side of the panel to limit downward pivoting of the hanger.

Hangers 15 and 35 of the foregoing type have been used for many years. In more recent years, it has become conventional to use a label holder in conjunction with a merchandise hanger. The holder displays a printed label which sets forth the price, stock number, name and other information concerning the merchandise supported by the hanger. One such holder has been designated as 50 in the drawings and is of the same general type as disclosed in Valiulis U.S. Pat. No. 4,976,058. The label holder 50 is characterized in that it may be used universally with both hangers 15 and 35 and may be adjusted to different heights so as to enable the holder to be positioned vertically in accordance with the specific merchandise on the hanger.

More specifically, the label holder 50 includes an elongated and relatively rigid arm 51 which is molded of plastic. In this particular instance, the arm is of an inverted T-shaped cross-section and includes a lower plate 52 and an upstanding web 53 (FIGS. 2 and 5).

Formed integrally with the outer end of the arm 51 is an upright plate 54 whose outer surface defines a support to which a label may be secured. The plate 54 is joined to the arm 51 near the upper end portion of the plate and thus the plate extends downwardly from the arm.

A bracket 55 is molded integrally with the inner end of the arm 51 and is configured to enable the holder 50 to be snapped onto both types of hangers 15 and 35. The upper end portion of the bracket is defined by an upright plate 56 to which the arm 51 is joined. Molded integrally with and depending from the plate are two laterally spaced legs 58.

Three sets of vertically spaced notches 63 are formed in the outboard edges of the legs 58. In addition, another set of notches 64 is formed in the outboard edges of the plate 56 just above the upper ends of the legs.

With the foregoing arrangement, the label holder 50 may be snapped onto the single-armed hanger 15 by inserting the legs 58 of the bracket 55 between the panel 11 and the cross-piece 18 and by pushing downwardly on the bracket to cause the legs to move downwardly between the horns 19 and to straddle the finger 17. As the legs move downwardly, they are cammed inwardly by the horizontal portions 20 of the horns 19. The resiliency of the plastic tends to return the legs to an outwardly spread position and, as a result, one of the sets of notches 63 snaps over and embraces the horizontal portions 20 of the horns to secure the holder 50 to the hanger 15. In FIG. 1, the horizontal portions 20 of the horns 19 are shown as being seated in the upper notches 63 and thus the holder 50 is installed with its arm 51 relatively close to the arm 16 of the hanger 15. If the merchandise is such as to require more clearance between the arms 16 and 51, the bracket 55 may be positioned such that the horizontal portions 20 of the horns 19 are received in the middle set of notches 63 or, if even greater clearance is required, in the lower set of notches.

When the holder 50 is used with the loop hanger 35 of FIG. 4, the horizontal portions 40 of the horns 39 are received in the notches 64 in the plate 56. Being at a higher level, the notches 64 compensate for the vertical portions 38 of the horns 39 of the hanger 35 and enable the arm 51 of the holder 50 to be positioned in close proximity to the arm sections 36 of the hanger 35. The holder may be installed on the hanger 35 by positioning the bracket 55 at an angle to the panel 11 and then by turning the bracket about a vertical axis to cause the notches 64 to move into embracing relation with the horizontal portions 40 of the horns 39.

It is desirable to keep the merchandise on the hanger 15, 35 positioned near the front of the hanger for greater visibility and accessibility. For this purpose, provision is made of an inventory control device or clip 70 which is positioned behind the merchandise and which may be slid along the hanger to keep the merchandise near the front of the hanger.

The present invention contemplates a new and improved inventory control clip 70 which helps hold the arm 51 of the label holder 50 in vertically spaced relation with the hanger 15, 35, which may be adjusted vertically to accommodate the height of the label holder arm, and which may be used universally with either the single-armed hanger 15 or the loop-type hanger 35. As a result, the control clip helps support the label holder arm and eliminates the need for providing different types of clips for different installations and different types of hangers.

More particularly, the present clip 70 is molded from a single piece of resiliently yieldable plastic such as polypropylene. The clip includes a generally triangular main body portion 71 defined by two laterally spaced and downwardly inclined webs 72 and by an upper crosspiece 73 spanning the upper end portions of the webs.

Extending upwardly from the crosspiece 73 of the body 71 are two laterally spaced fingers 75 which straddle and engage the label holder arm 51 and retain the clip 70 on the arm. Herein, each finger includes a vertical portion 76 extending along the adjacent side edge of the plate 52 of the arm 51 and located in frictional engagement with such side edge. Each finger further includes an inwardly inclined upper portion 77 whose free end engages the web 53 of the arm 51.

The clip 70 is installed on the label holder arm 51 from beneath the arm by spreading the fingers 75 and by slipping the fingers up onto the arm. To facilitate spreading of the fingers, an upwardly opening notch 78 is formed in the upper side of the crosspiece 73 to enable the fingers to flex. Also, a tab 79 projects outwardly from the vertical portion 76 of one of the fingers (herein, the right finger) and may be depressed by one's thumb to flex that finger outwardly away from the other finger. Once the fingers 75 have been snapped onto the arm 51, they resiliently grip and frictionally engage the arm so as to restrict sliding of the clip along the length of the arm.

Molded integrally with and extending downwardly from the lower end portions of the webs 72 of the main body 71 of the clip 70 are two laterally spaced and upright legs 80. When the clip is used with the hanger 15, the legs 80 are adapted to straddle and grip the arm 16 of the hanger to retain the clip on the hanger arm and to restrict sliding of the clip along the length of the arm.

Advantageously, retention means are formed on the inboard sides of the legs 80 and permit the clip 70 to be adjusted to and held releasably in various vertical positions relative to the hanger arm 16. While the retention means could be generally semi-circular recesses or notches in the inboard sides of the legs, they herein are in the form of vertically spaced sets of horizontally aligned nibs 81 which project inwardly from the inboard sides of the legs. In this instance, there are four vertically spaced sets of nibs which divide the space between the legs 80 into three distinct pockets 82 (FIG. 5). The hanger arm 16 is received in one of the pockets 82 and its upper side engages the lower sides of the adjacent overlying nibs 81. In this way, the hanger arm 16 supports the clip 70 which, in turn, supports the label holder arm 51 and prevents the latter from flexing downwardly onto the merchandise. Thus, the clip establishes a predetermined vertically spaced relation between the arms 16 and 51.

When the label holder 50 is adjusted upwardly or downwardly relative to the hanger 15 as permitted by the notches 63, the clip 70 also may be adjusted vertically relative to the hanger simply by causing the hanger arm 16 to be located within a different one of the pockets 82. Accordingly, the pockets enable the clip to be adjusted vertically in accordance with the vertical position of the label holder. The pockets also enable the clip to be used with hanger arms of different diameters.

Advantageously, the clip 70 also may be used with the loop-type hanger 35. For this purpose, the clip is formed with two laterally spaced outboard legs 85 which are spaced outwardly from and extend generally parallel to the inboard legs 80. Integral webs 86 join the lower end portions of the outboard legs 85 to the lower end portions of the inboard legs 80 and permit the outboard legs to flex toward and away from the inboard legs. The outboard side of each outboard leg 85 is formed with four outwardly projecting and vertically spaced nibs 87 which define three vertically spaced pockets 88 (FIG. 2) along the outboard side of each leg.

When the clip 70 is used with the loop-type hanger 35, the fingers 75 engage the label holder arm 51 the same as before. The legs 85, however, are located between the arms 36 of the hanger with the arms being seated in one of the three sets of pockets 88. When the legs 85 are relaxed, the lateral dimension across the legs is somewhat greater than the lateral dimension between the arms 36. Thus, the legs are flexed toward one another as an incident to being placed between the arms and then tend to spring apart into frictional engagement with the arms.

As before, the upper sides of the arms 36 engage the lower sides of the immediately overlying nibs 87 and act through the clip 70 to maintain a predetermined vertical spacing between the arms 36 and the arm 51. The clip 70 may be raised or lowered to cause the arms 36 to be received in different ones of the pockets 88 and thereby change the elevation of the arm 51, the bracket 56 pivoting on the horizontal portions 40 of the horns 39 to permit the elevation of the outer portion of the arm to change. And, as before, the clip 70 may be slid to different positions on the arms 36 and 51 to keep merchandise positioned near the front of the hanger 35.

We claim:

1. The combination of, generally horizontally extending hanger arm means, a label holder having a generally horizontally extending arm spaced above the hanger arm means, and a merchandise control clip, said combination being characterized in that said clip is made from a single piece of plastic and includes a body portion with a pair of laterally spaced and upwardly projecting fingers which straddle and engage said label holder arm to retain said clip on said label holder arm, and a pair of laterally spaced and upright legs integral with said body portion and positioned below said fingers in engagement with said hanger arm means to retain said clip on said hanger arm means, said fingers and said legs being adjustable along the length of said label holder arm and said hanger arm means, respectively, and retention means on said legs permitting said legs to be adjusted to and retained in various vertical positions relative to said hanger arm means.

2. The combination defined in claim 1 in which said legs include oppositely facing inboard sides, said retention means being spaced vertically along the inboard sides of said legs.

3. The combination defined in claim 1 in which said legs include oppositely facing outboard sides, said retention means being spaced vertically along the outboard sides of said legs.

4. The combination of, a generally horizontal hanger arm, a label holder having a generally horizontally extending arm spaced above and aligned with said hanger arm, and a merchandise control clip, said combination being characterized in that said clip is made from a single piece of plastic and includes a body portion with a pair of upwardly projecting and laterally spaced fingers disposed in straddling relation with said label holder arm to retain said clip on said label holder arm, and a pair of laterally spaced and upright legs integral with and depending from said body portion in engagement with said hanger arm to retain said clip on said hanger arm, said fingers and said legs being adjustable along the length of said label holder arm and said hanger arm respectively, said legs including oppositely facing inboard sides, and retention means spaced vertically along the inboard sides of said legs and permitting said legs to be adjusted to and retained in various vertical positions relative to said hanger arm.

5. The combination of, a hanger having a pair of laterally spaced and generally horizontally extending hanger arms, a label holder having a generally horizontally extending arm spaced above and substantially centered between said hanger arms, and a merchandise control clip, said combination being characterized in that said clip is made from a single piece of plastic and includes a body portion with a pair of upwardly projecting and laterally spaced fingers disposed in straddling relation with said label holder arm to retain said clip on said label holder arm, and a pair of laterally spaced and upright legs integral with and positioned below said fingers and located between said hanger arms, said legs including oppositely facing outboard sides disposed in engagement with said hanger arms, and retention means spaced vertically along the outboard sides of said legs and permitting said legs to be adjusted to and retained in various vertical positions relative to said hanger arms.

6. A merchandise control clip for use with generally horizontally extending hanger arm means and with a label holder having a generally horizontally extending arm spaced above the hanger arm means, said clip being made from a single piece of plastic and having a body portion with a pair of laterally spaced and upwardly projecting fingers adapted to straddle and engage said label holder arm thereby to retain said clip on said label holder arm, and a pair of laterally spaced and upright legs integral with said body portion and positioned below said fingers to engage said hanger arm means and retain said clip on said hanger arm means, said fingers and said legs being adjustable along the length of said label holder arm and said hanger arm means, respectively, and retention means on said legs permitting said legs to be adjusted to and retained in various vertical positions relative to said hanger arm means, said legs comprising first and second inboard leg sections depending from said body portion and each having a lower end portion, first and second outboard leg sections spaced laterally outwardly from and extending generally parallel to said first and second inboard leg sections, respectively, and each having a lower end portion, and means integral with each of said legs and joining the lower end portion of each inboard leg section to the lower end portion of the respective outboard leg section.

7. A merchandise control clip as defined in claim 6 in which said inboard leg sections include oppositely facing inboard sides, said outboard leg sections including oppositely facing outboard sides, said retention means being spaced vertically along the inboard sides of said inboard leg sections and along the outboard sides of said outboard leg sections.

8. A merchandise control clip for use with a generally horizontal hanger arm and with a label holder having a generally horizontally extending arm spaced above and aligned with said hanger arm, said clip being made from a single piece of plastic and having a body portion with a pair of upwardly projecting and laterally spaced fingers adapted to be spread apart and placed in straddling relation with said label holder arm thereby to retain said clip on said label holder arm, and a pair of laterally spaced and upright legs integral with and depending from said body portion to engage said hanger arm and retain said clip on said hanger arm, said fingers and said legs being adjustable along the length of said label holder arm and said hanger arm, respectively, said legs including oppositely facing inboard sides, and retention means spaced vertically along the inboard sides of said legs and permitting said legs to be adjusted to and retained in various vertical positions relative to said hanger arm, said legs comprising first and second inboard leg sections each having a lower end portion, first and second outboard leg sections spaced laterally outwardly from and extending generally parallel to said first and second inboard leg sections, respectively, and each having a lower end portion, means integral with said legs and joining the lower end portion of each inboard leg section to the lower end portion of the respective outboard leg section, said outboard leg sections including oppositely facing outboard sides, and additional retention means spaced vertically along the outboard sides of said outboard leg sections.

9. A merchandise control clip for use with a hanger having a pair of laterally spaced and generally horizontally extending hanger arms and with a label holder having a generally horizontally extending arm spaced above and substantially centered between said hanger arms, said clip being made from a single piece of plastic and having a body portion with a pair of upwardly projecting and laterally spaced fingers adapted to be spread apart and placed in straddling relation with said label holder arm thereby to retain said clip on said label holder arm, and a pair of laterally spaced and upright legs integral with and positioned below said fingers and located between said hanger arms, said legs including oppositely facing outboard sides engagable with said hanger arms, and retention means spaced vertically along the outboard sides of said legs and permitting said legs to be adjusted to and retained in various vertical positions relative to said hanger arms, said legs comprising first and second outboard leg sections each having a lower end portion, first and second inboard leg sections located between and extending generally parallel to said first and second outboard leg sections, respectively, said inboard leg sections being formed integrally with and depending from said body portion and each having a lower end portion, means integral with said legs and joining the lower end portion of each inboard leg section to the lower end portion of the respective outboard leg section, said inboard leg sections including oppositely facing inboard sides, and additional retention means spaced vertically along the inboard sides of said inboard leg sections.

* * * * *